US011891264B2

(12) United States Patent
Libeau

(10) Patent No.: US 11,891,264 B2
(45) Date of Patent: Feb. 6, 2024

(54) SYSTEM FOR PRODUCING YARN

(71) Applicant: Jean-Michel Libeau, Wanaka (NZ)

(72) Inventor: Jean-Michel Libeau, Wanaka (NZ)

(73) Assignee: Jean-Michel Libeau, Wanaka (NZ)

( * ) Notice: Subject to any disclaimer, the term of this patent is extended or adjusted under 35 U.S.C. 154(b) by 0 days.

(21) Appl. No.: 17/583,183

(22) Filed: Jan. 24, 2022

(65) Prior Publication Data

US 2023/0234807 A1 Jul. 27, 2023

(51) Int. Cl.

| | |
|---|---|
| ***B65H 59/18*** | (2006.01) |
| ***B65H 59/38*** | (2006.01) |
| ***D02G 3/04*** | (2006.01) |
| ***D02G 3/22*** | (2006.01) |
| ***B65H 63/06*** | (2006.01) |

(52) U.S. Cl.

CPC ..... *B65H 59/18* (2013.01); *B65H 59/388* (2013.01); *B65H 63/06* (2013.01); *D02G 3/04* (2013.01); *D02G 3/22* (2013.01); *B65H 2404/143* (2013.01); *B65H 2553/40* (2013.01)

(58) Field of Classification Search

CPC ..... D02G 3/04; D02G 3/22; B65H 59/18; B65H 59/388; B65H 63/06; B65H 2404/143; B65H 2553/40

See application file for complete search history.

(56) References Cited

U.S. PATENT DOCUMENTS 3,264,816 A * 8/1966 Jaggi ..... D02G 3/324 57/228
3,350,867 A * 11/1967 Morrison ..... D02G 3/34 57/210
3,365,872 A * 1/1968 Field, Jr. ..... D02G 3/367 57/328
3,367,095 A * 2/1968 Field, Jr. ..... D02G 3/367 57/328
4,069,656 A * 1/1978 Arai ..... D02G 3/38 57/328
4,903,472 A * 2/1990 Vanhelle ..... D02G 3/367 57/280
5,115,630 A * 5/1992 Vanhelle ..... D02G 3/367 57/328
H1225 H * 9/1993 Foy ..... 57/328
5,551,225 A * 9/1996 Maruki ..... D01H 11/00 57/328
5,699,661 A * 12/1997 Maruki ..... D01H 7/923 57/328
7,913,483 B2 * 3/2011 Qiu ..... D02G 3/367 57/18
8,209,948 B2 * 7/2012 Takahashi ..... A62B 17/003 57/210

(Continued)

FOREIGN PATENT DOCUMENTS

JP 2008214812 A * 9/2008
WO WO-2012100305 A1 * 8/2012 ..... D02G 3/367

*Primary Examiner* — Shaun R Hurley

(74) *Attorney, Agent, or Firm* — Reising Ethington P.C.

(57) ABSTRACT

The invention relates to a system of spinning yarn that comprises a filament feed system configured to vary the tension applied to at least two continuous filaments before the filaments are introduced to a roving and twisted to form a yarn. The invention allows the filaments to be introduced to the roving when under tension, under no tension, or when under slack at set distances from the roving centre line by a specialized two filament guide.

6 Claims, 4 Drawing Sheets

(56) References Cited

U.S. PATENT DOCUMENTS

| | | | | |
|---|---|---|---|---|
| 10,161,066 | B2 * | 12/2018 | Yeung | D01H 1/025 |
| 2002/0152738 | A1 * | 10/2002 | Musha | D01H 5/36<br>57/243 |
| 2005/0133653 | A1 * | 6/2005 | Heaney | B65H 57/16<br>242/410 |
| 2009/0178757 | A1 * | 7/2009 | Cocovi | B29D 30/44<br>156/397 |
| 2010/0162677 | A1 * | 7/2010 | Qiu | D02G 3/367<br>57/12 |
| 2013/0269160 | A1 * | 10/2013 | Honeycutt | D02H 13/26<br>28/194 |
| 2013/0298519 | A1 * | 11/2013 | Smith | D02G 3/32<br>57/224 |

* cited by examiner

SYSTEM FOR PRODUCING YARN

TECHNICAL FIELD

The invention relates to a system for producing yarn.

BACKGROUND OF THE INVENTION

It is known to introduce multiple continuous filaments to staple fibres during the spinning process (such as cotton, cellulose or wool for example) and to wrap the filaments around the staple fibres to form a yarn. This technology has led to the development of new yarns and fabrics where the continuous filaments provide the yarns with additional performance characteristics after manufacture. Yarns using continuous filaments may comprise of shorter staple fibres than conventional yarns because of the support provided by the continuous filaments during the spinning process. The use of continuous filaments may also allow for yarns to be produced with less staple fibres in the cross section and lower twist per meter than conventionally formed yarns. The applicant has discovered that by using at least two continuous filaments within a yarn and by locating the filaments in a desired position when the yarn is being spun, it may be possible to modify the properties of the yarn, such as increasing the elongation, increasing the tenacity (strength) of the yarn, increase in abrasion resistance of the resulting fabrics, reducing pilling of the fabrics, and improving the burst strength and tear resistance. Despite these technological developments, there is an ongoing need to create different types of yarns having properties suited to the purpose for which the yarns will be used. In other words, the textile industry has an ongoing need for purpose-specific yarns to be created, such as: a high burst strength and tear resistant yarn for fabric to be used in a knitted shoe upper, high abrasion resistance for automobile seat; or a soft, moisture management yarn to be used in a next-to-skin fabric. It is therefore an object of the invention to provide a system for producing yarns having different structures of fibre and filaments, or to at least provide a specialized alternative to existing yarn producing systems.

SUMMARY OF THE INVENTION

In a first aspect of the invention there is provided a system for producing a yarn comprising at least two continuous filaments and a plurality of staple fibres that form a roving. The system comprises at least one filament feed system configured to apply a predetermined amount of tension or no tension to the filaments before the filaments are introduced to the roving or to cause the filaments to be introduced to the roving under slack. In one form, the filament feed system comprises a driven roller; a press roller; and a drive system. The press roller is positioned adjacent the driven roller and is configured to press at least two filaments between the driven roller and press roller. The drive system is operatively connected to the driven roller to cause the driven roller to rotate at a desired predetermined speed.

The drive system may comprise a programmable controller to control and vary the rotational speed of the driven roller. Optionally, the filament feed system comprises two driven rollers and two press rollers, each press roller being configured to press against a respective driven roller. In one form, the drive system is configured to cause both of the driven rollers to rotate at a predetermined speed. Optionally, the filament feed system comprises two drive systems, each drive system being operatively connected to one of the driven rollers to cause that driven roller to rotate at a desired predetermined speed. Preferably, the drive system(s) is/are configured to cause one driven to rotate at a speed different to the other driven roller. Preferably, the filament feed system is configured to apply a predetermined amount of tension to at least one filament before the filaments are introduced to the staple fibres. Optionally, the filament feed system is configured to introduce the filament(s) to the roving without placing any tension on the filament(s). In one form, the filament feed system comprises a closed feedback loop in which the filament feed system comprises one or more sensors to measure the rotational speed of the driven roller(s), wherein the one or more sensors are configured to provide the measured rotational speed data to the drive system(s), and wherein the drive system(s) comprise(s) a controller that compares the desired rotational speed with the measured rotational speed of the driven roller(s) and causes the drive system(s) to adjust the rotational speed of the driven roller(s) to equal the desired rotational speed, if the measured rotational speed is different to the desired rotational speed or the driven roller(s). Preferably, after exiting the filament feed system, the filaments are introduced to the roving via a guide comprising a rotating roller in which a pair of substantially V-shaped channels are formed, wherein each channel is configured to receive a filament therein, and wherein the channels are spaced from each other at a distance of between 3 to 13 mm. In one form, the system comprises at least an optical sensor configured to identify breakages in at least one filament before the filaments are introduced to the roving. Optionally, the filament feed system is configured to introduce two pairs of filaments into two roving's, each pair of filaments being introduced to one of the rovings. The term "comprising" as used in this specification means "consisting at least in part of". When interpreting each statement in this specification that includes the term "comprising", features other than that or those prefaced by the term may also be present. Related terms such as "comprise" and "comprises" are to be interpreted in the same manner.

Any reference to prior art documents in this specification is not to be considered an admission that such prior art is widely known or forms part of the common general knowledge in the field. This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

BRIEF DESCRIPTION OF THE FIGURES

Preferred embodiments of the invention will be described by way of example only and with reference to the drawings, in which.

DETAILED DESCRIPTION

The invention relates to a filament feed system to be used with a system for producing a yarn comprising two or more continuous filaments and a plurality of staple fibres that form a roving. The staple fibres may be short staple fibres or long staple fibres. The staple fibres may include, but are not limited to cotton, wool, synthetic fibres, and cellulose fibres. The roving moves along the system and is drafted to stretch the fibres into a substantially straight orientation and to a line the fibres laterally of the roving. The yarn producing system is configured to introduce at least two continuous filaments into the roving, after drafting. The filament(s) may be any continuous filament for use in a yarn and may include, but are not limited to nylon, polyester, cellulose, silk, cotton, thread, yarn, and suitable man made natural and synthetic filaments. The filament feed system of the invention is configured to apply a predetermined amount of tension to each filament before the filament is introduced to the roving. The system is therefore able to introduce the filament(s) either under tension, under no tension, or under slack before the filament(s) and roving are twisted together to form a yarn that is wound onto a spool, ready to be rewound for knitted or woven into a fabric.

Figure 1:
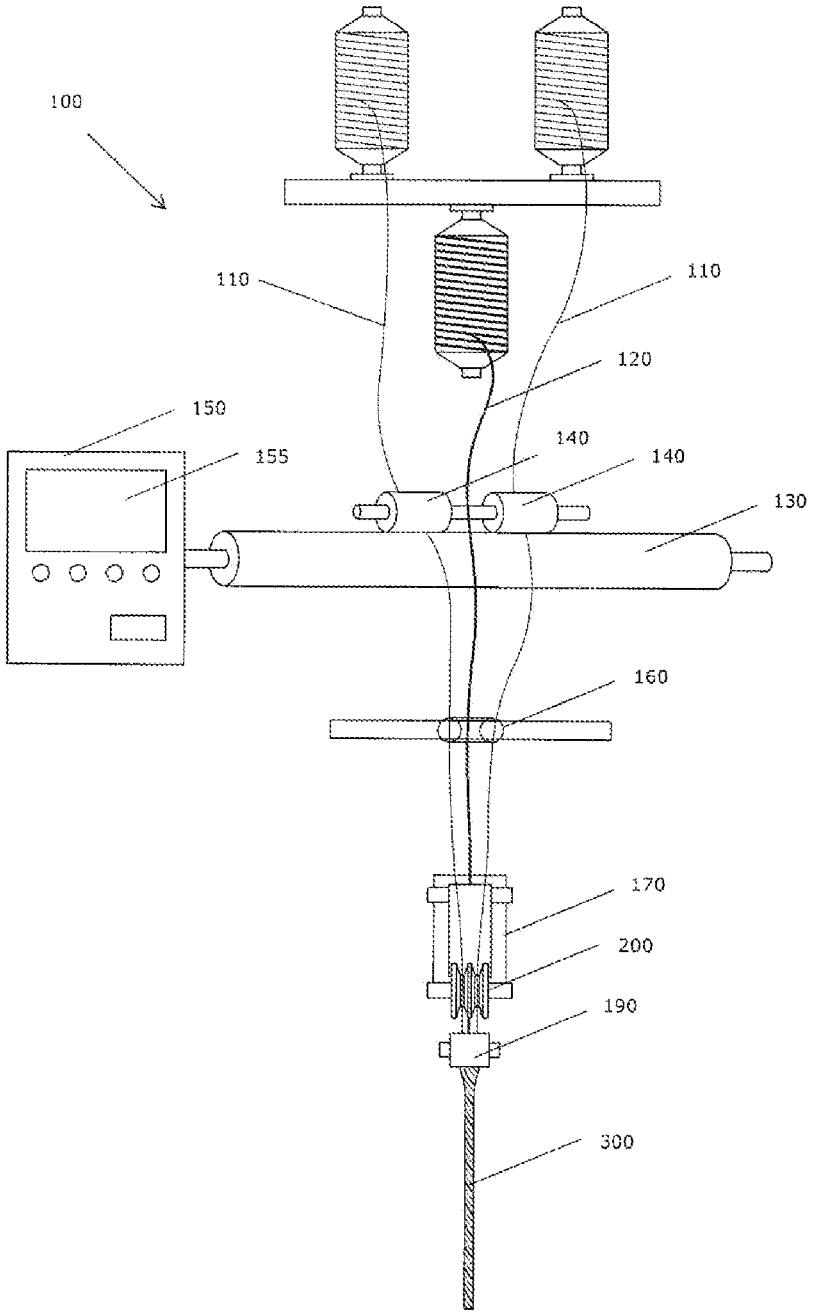
FIG. 1 is a schematic illustration of a yarn producing system comprising a filament feed system according to one aspect of the invention.
Figure 2:
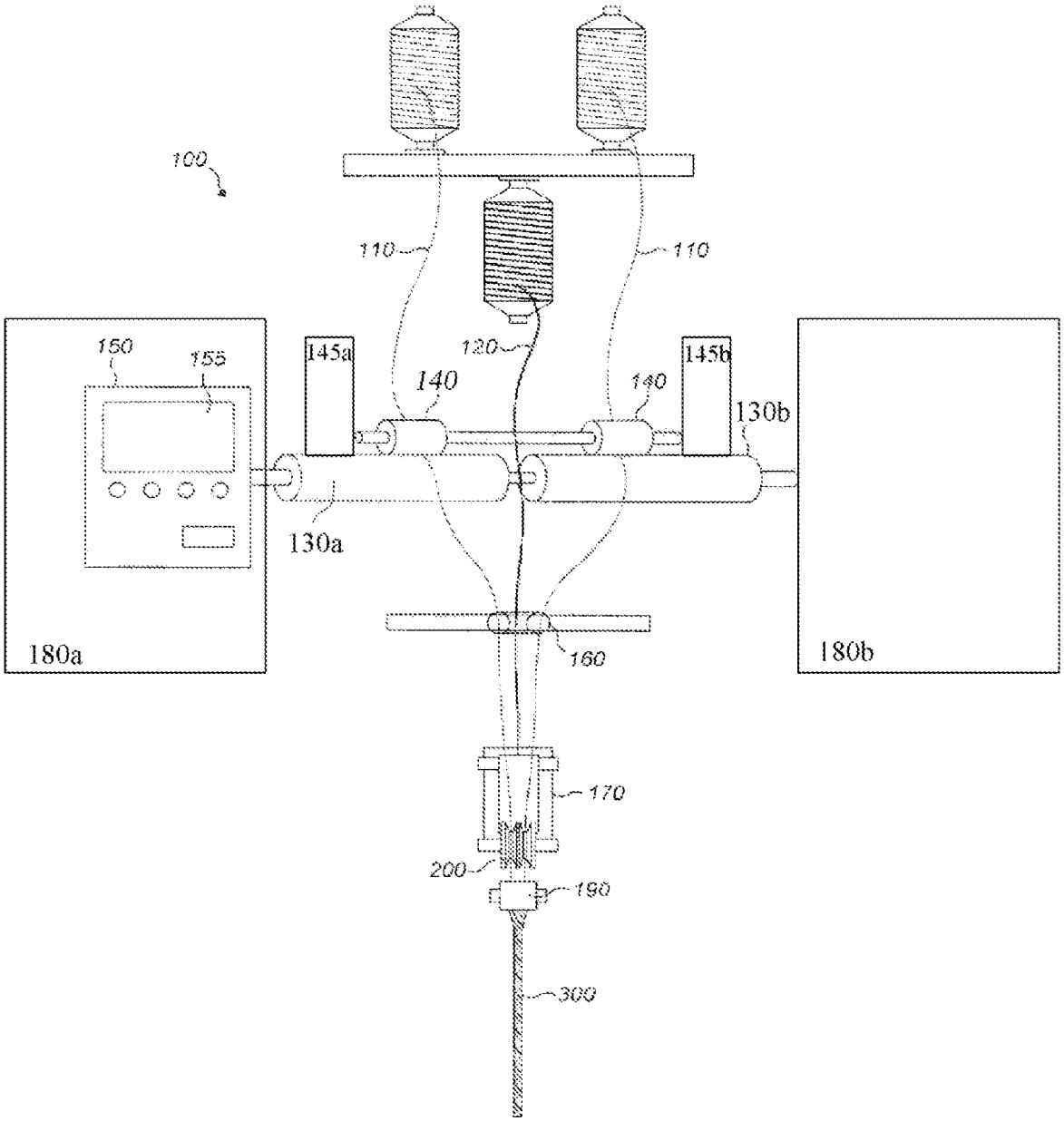
FIG. 2 is a schematic illustration of a yarn producing system comprising a filament feed system according to another aspect of the invention.

As shown in FIG. 1, the filament feed system 100 typically comprises a driven roller 130; a press roller 140; and a drive system. The drive system comprises a motor that is operatively connected to the driven roller and is configured to cause the driven roller to rotate about its longitudinal axis—preferably at a desired predetermined rotational speed, measured in revolutions per minute (rpm) or meters per second (m*5). The driven roller and press roller are typically substantially cylindrical. The curved surfaces of the rollers form contact surfaces that contact at least two continuous filaments during use. The press roller is positioned adjacent the driven roller so that the contact surfaces of the press roller and driven roller touch each other and the at least two continuous filament is sandwiched in between. The filament feed system may be configured so that a user can manually set up the system to impart the desired amount of tension to the filament(s). Alternatively, as shown in FIG. 1, the system may be operated by a programmable controller 150. In one form, the drive system comprises a programmable controller 150 that controls the drive system motor in order to control and vary the rotational speed of at least the driven roller 130. In one form, the drive system is operatively connected to both the driven roller 130 and the press roller 140 and causes both rollers 130,140 to rotate, preferably at a desired predetermined speed. In this form, the controller 150 may be configured to control and vary the rotational speed of both the driven roller 130 and the press roller 140. The controller 150 may comprise a user interface 155 through which an operator can program or instruct the system to apply the desired amount of tension to the filament(s) 110 by varying the rotational speed of at least the driven roller 130 and optionally by varying the rotational speed of the press roller 140 also. In one form, the filament feed system 100 comprises two driven rollers and two press rollers, each press roller being configured to press against a respective driven roller, as described above. In this form, the drive system may be operatively connected to both driven rollers and may be configured to cause both driven rollers to rotate. In another form, as shown in FIG. 1, the driven roller 130 is a long roller and two or more press rollers 140 are located adjacent the driven roller to sandwich two or more filaments 110 between the driven roller and press rollers. Again, the drive system may be operatively connected to the press rollers to control and vary the rotational speed of the press rollers in addition to the driven roller. Alternatively, the drive system may be operatively connected to both driven rollers and both press rollers to cause all four rollers to rotate. In yet another form, the filament feed system comprises two drive systems. In this form, a first drive system is connected to a first driven roller and is optionally connected to a first press roller to cause the first roller(s) to rotate. A second drive system is connected to a second driven roller and is optionally connected to a second press roller to cause the second roller(s) to rotate. Alternatively, one drive system may control and vary the rotation speed of both driven rollers and the other drive system may control and vary the rotational speed of the press rollers. Again, a programmable controller may be used to control and vary the rotational speed of the rollers of both drive systems or each drive system may comprise a separate programmable controller. Alternatively, one or both drive systems may comprise a manually operated control system to control the rotational speed of the roller(s). The drive system(s) may be configured to cause both driven rollers (and optionally both press rollers) to rotate at a desired predetermined speed. In another form, the drive system(s) may be configured to cause one driven roller (and optionally the adjacent press roller) to rotate at a speed different to the other driven roller (and press roller, as the case may be). The system is configured so that, in use, at least two continuous filaments 110 is fed between the rotating contact surfaces of a driven roller 130 and a press roller 140, as shown in FIG. 1. In one form, the tension applied to the continuous filaments 110 can be varied by varying the speed of rotation of the driven roller 130 compared to the linear speed of the roving 120 passing through the yarn spinning system. By reducing the speed of rotation of the driven roller 140, the continuous filament 110 is placed under tension as it is introduced to the roving 120. In one form, the filament feed system 100 is configured to introduce the filament(s) 110 to the roving 120 without placing any tension on the filament(s) 110. For example, by rotating the driven roller 130 at a speed that is substantially equal to the linear speed of the roving 120, it is possible to introduce the filament 110 to the roving 120 when the filament is under substantially no tension. In yet another form, the drive system may be configured to cause the driven roller 130 to rotate at a speed faster than the linear speed of the roving so that the continuous filament 110 is pushed onto the roving 120 in a slack state. By varying the tension applied to the continuous filaments, it is possible to vary the fibre structure of the yarns produced and to therefore vary the properties of the yarns. In one form, the filament feed system 100 is configured to feed at least two filaments 110 between a driven roller 130 and one or two adjacent press rollers 140. Alternatively, as described above, the filament feed system may be configured to feed two filaments between a pair of first and second driven rollers and adjacent press rollers. In this form, a first filament is fed between the first driven roller and press roller and a second filament is fed between the second driven roller and press roller before the filaments are fed into a roving. Optionally, the system may be configured to apply different tensions to the first and second filaments. For example, the filament feed system may be configured so that a first filament is introduced to a roving under tension and a second filament is introduced to the roving under no tension or is introduced to the roving under slack. Alternatively, a first filament may be introduced to a roving under no tension and a second filament may be introduced to the roving under slack. Different levels of tension can be obtained by programming the controller or manually setting up the system to cause the first driven roller to rotate at the same speed or at a different speed to the second driven roller. For example, in one form, as shown in FIG. 2, the system comprises two drive systems 180*a* and 180*b*. Each drive system may comprise or consist of a drive motor. A first drive motor is configured to drive a first driven roller 130*a* and a second drive motor is configured to drive a second driven roller 130*b*. The drive motors may be controlled manually; by a single programmable controller; or a separate programmable controller may control each drive motor. Each driven motor is configured to be in contact with a press roller 140, as described above. Optionally, a first driven roller 130*a* is engaged with and driven by a first drive shaft. The first driven roller has a central bore through which the first drive shaft projects. The first drive shaft has a central bore in which a second drive shaft is located and projects beyond the first driven roller 130 to engage with the second driven roller 130*b*. The second drive shaft may engage with one end of the second driven roller (such as by being connected to one end of the second driven roller) but preferably passes through and engages with a central longitudinal bore of the second driven roller. The second driven roller 130*b* is driven by the second drive shaft, which is configured and dimensioned to rotate freely within the first drive shaft, as shown in FIG. 2. Typically, the second drive shaft is supported by bearings with the central bore of the first drive shaft and first driven roller. In yet another form, the system is configured so that the first and second drive shafts are separate from each other. In this form, the first drive shaft is configured to drive the first driven roller at a desired speed and the second drive shaft is configured to drive the second driven roller at a desired speed. In one form, the system is configured to introduce a pair of filaments into two rovings at the same time. For example, the filament feed system may be configured to feed four filaments between one or more pairs of driven rollers and press rollers. In this form, the filament feed system may comprise at least one pair and up to two pairs of rotating driven and press rollers. In one example, two filaments are fed between a first driven roller and press roller and two other filaments are fed between a second driven roller and press roller. Two of the four filaments are then introduced to a first roving and the other two filaments are introduced to a second roving. In one form, the filament feed system comprises a closed feedback loop. In this form, the filament feed system comprises one or more sensors 145*a* and 145*b* to measure the rotational speed of the driven roller(s) and optionally also the press roller(s). The measured rotational speed data from the sensors is provided to the drive system(s), either as batched data or continuously. The drive system(s) comprise(s) a controller that compares the desired rotational speed with the measured rotational speed of the driven roller(s) and causes the drive system(s) to adjust the rotational speed of the driven roller(s) to equal the desired rotational speed, if the measured rotational speed is different to the desired rotational speed or the driven roller(s). In this way, the filament feed system can monitor the tension levels applied to the filament(s) and can self-correct the tension levels when required. In one form, the system comprises a breakage checkpoint 160, which may comprise at least one optical sensor configured to identify breakages in at least one filament before the filament is introduced to the roving at the drafting area. For example, the filament may be passed in front of an optical sensor that identifies when the filament breaks. In one form, the optical sensor may be located next to or within eyelets through which the filaments pass, as shown in FIG. 1. Where the sensor identifies a breakage, the sensor may provide a signal to the controller of the drive system to stop the yarn production system. Optionally, the control system also causes an audio and/or visual alert to be generated to bring the breakage to the attention of an operator so that the problem can be resolved promptly, and the yarn production system can be restarted. Alternatively, the sensor may issue its own alert so that an operator seeing and/or hearing the alert can stop the yarn production system and resolve the problem.

Figure 3:
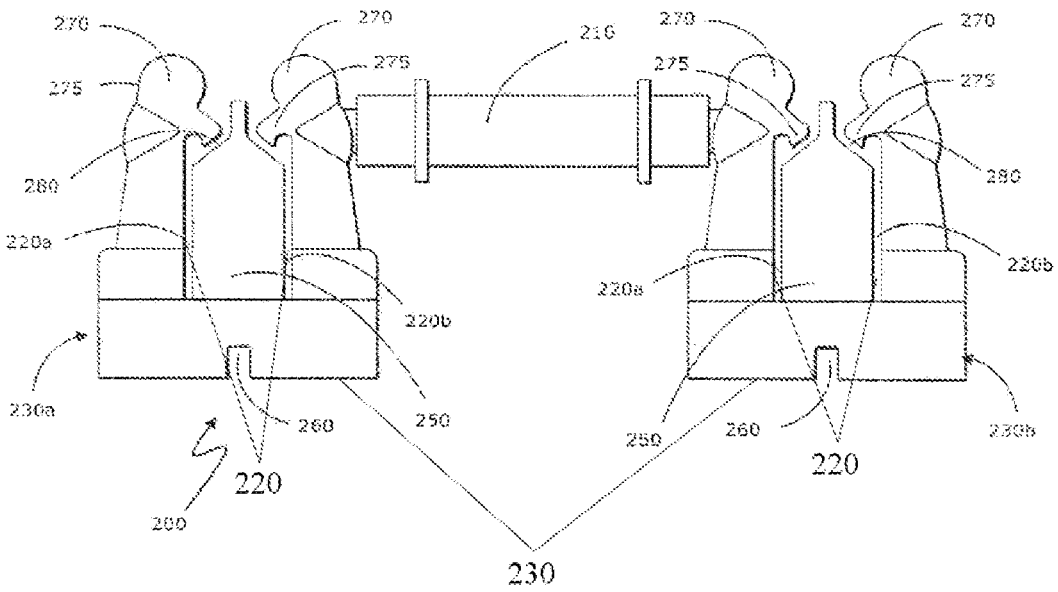
FIG. 3 is a front view of one form of positioning guide according to the invention.
Figure 4:
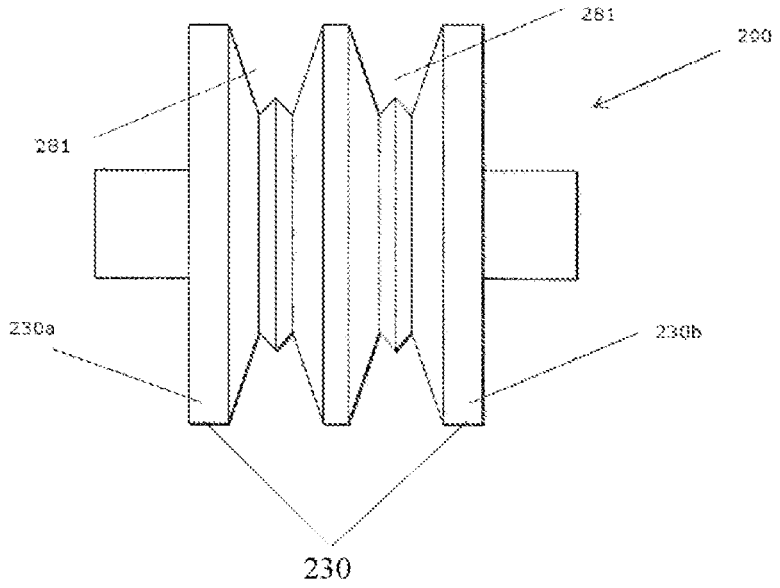
FIG. 4 is a front view of another form of positioning guide according to the invention.

Next, the at least one filament optionally passes through a positioning guide 200 having a body 210 and one or more guide channels 220 to guide one or more filaments 110 toward a desired location on or next to a roving 120 before the filament(s) and roving is/are twisted together to form a yarn. The applicant has discovered that it is possible to produce yarns having particular properties by varying the location at which the at least two filaments are introduced to the roving. For example, by introducing two filaments at different distances to one edge of the roving, the resultant yarn will have a different fibre structure and different properties than if the filament is introduced to the centre of the roving. The applicant has also discovered that it is possible to vary the fibre structure of the yarns by introducing two different filaments to the roving at different set distances. The positioning guide of the invention is configured to guide two or more filaments toward a set location or locations on or next to the roving to produce a yarn having a desired fibre structure. The invention may therefore be used to create a yarn having a predetermined fibre structure to provide the yarn with properties that are suited for use in a fabric having a known purpose. For example, the invention may be used to produce a yarn having a high tenacity strength and elongation. Such a yarn would be well suited for use in fabrics for shoe upper and sportswear. The invention may also be used to produce a yarn that, when woven into a fabric, has high abrasion resistance and a burst strength, high tear strength and low susceptibility to pilling. Such yarns may be used to produce fabrics suitable for shoe uppers and automotive seats. As shown in FIGS. 3 to 5, the positioning guide 200 of the invention comprises a body 210 and one or more guide channels 220 formed in the body. Each channel 220 is configured to receive a continuous filament 110 and to guide the filament toward a desired location next to a roving 120 in the drafting area. Optionally, the guide 200 comprises two or more channels 220 to guide two or more filaments 110 to a desired location with respect to a roving 120. In one form, the positioning guide 200 may comprise four channels 220 to guide four filaments 110 toward a desired location on or next to the roving 120. Alternatively, the guide 200 may be located between two (first and second) yarn production systems operating in parallel. In this form, the guide may be configured to guide two of the filaments to a desired location in relation to the roving of the first yarn production system and to simultaneously guide the other two filaments to a desired location in relation to the roving of the second yarn production system. FIG. 3 shows one form of positioning guide 200 according to the invention. The guide 200 is configured to guide four filaments 110 into a pair of roving's 120 running in parallel, as described above. The guide 200 typically comprises a body 210, a first portion 230*a* located at a first end of the body 210 and a second portion 230*b* located at a second end of the body 210. The first and second portions 230*a*, 230*b* each comprise a pair of first and second guide channels 220*a*, 220*b*. Each channel 220 is configured to receive a filament 110 therein so that the moving filament passes through and is guided by the channel 220 as the filament is introduced to the roving 120. The first and second channels 220*a*, 220*b* in each of the first and second portions are separated by a spacer 250 configured to space the channels 220*a*, 220*b* between 3 to 13 mm apart from the centre roving guide grove 260. The spacer 250 is typically placed to guide the filaments between 3 to 13 mm left and right of the centre line where the roving guide 260 is. Optionally, the guide 200 comprises a mounting system for mounting the positioning guide at an appropriate location on the yarn production system. In one form, the mounting system comprises a shaft 210, the shaft being formed across the top of the first left and second right guide both having 230*a*, 230*b* of the positioning guide, as shown in FIG. 3. In one form, each recess 260 is approximately 5 mm wide and approximately 10 mm deep. The recesses 260 are configured to engage with the roving of the yarn producing system to support or hold the roving in position during use. In one form, the shaft 210 is configured to engage with and be supported by a supporting structure of the yarn production system, such as a portion of a roller or supporting arm for a roller. However, it is envisaged that in other forms, the shaft may be configured to engage with and be supported by any suitable supporting structure in the yarn producing system. In yet another form, the mounting system may comprise one or more projecting members for being received within one or more recesses or apertures in a supporting structure of the yarn producing system. Other suitable mounting systems may alternatively be used to support or hold the positioning guide in position. The body 210 of the positioning guide may also be configured to be held to support the guide during use. In one form, the body 210 is substantially cylindrical and is substantially centrally located between the first 230*a* and second 230*b* portions of the guide 200. An annular flange is located at or near each end of the body 210 and extends substantially around the entire circumference of the body 210. In this form, the positioning guide may be fitted onto a drafting arm of a drafting roller by locating the body of the positioning guide within an opening in the drafting arm so that the first and second portions of the positioning guide extend from either side of the drafting arm. Optionally, at least the innermost arms of the positioning guide also comprise a strengthened region for connecting the arms to the body of the positioning guide. In one form, as shown in FIG. 3, the strengthened region may be a thickened region, or a lug formed on the innermost arms of the guide 200. In one form, each lug is approximately 6 mm long and 5.5 mm in diameter. In the embodiment shown in FIG. 3, lugs are provided on all four arms of the positioning guide, although it is not necessary to have lugs on the outermost arms. The positioning guide may also be configured to help prevent each filament from being inadvertently pulled out of its respective channel during use. In one form, as shown in FIG. 3, the first and second portions 230*a*, 230*b* each comprise a pair of arms 270. Each arm 270 is configured to project across at least a portion of an adjacent guide channel 220. In one form, each projecting arm 270 comprises a hook 275 that curves over a portion of an adjacent guide channel 220 to help prevent the filament 110 in that channel 220 from pulling out of the channel 220 during use. In other forms, each projecting arm 270 is substantially linear and extends substantially across the adjacent channel 220 at any suitable angle to help prevent the filament 110 in that channel 220 from pulling out of the channel 220 during use. In one form, in each pair of first and second guide channels 220*a*, 220*b*, one arm 270 is located adjacent to each channel 220 and projects toward the spacer 250 located between the first and second channels 220*a*, 220*b*. An opening is provided between the spacer 250 and each projecting arm 270 to form a path 280 along which each filament 110 can pass as the filament is being located within its respective guide channel 220 and as it is being removed from the channel 220 by an operator when the yarn producing system is not operating. Optionally, the arms are configured to taper toward the tops of the arms. The positioning guide may be made of any suitable material, such as a ceramic, metal or plastic material. In one form, the positioning guide is made from an injection moulded polymer. The positioning guide may be of any suitable dimensions. In one form, the positioning guide is approximately 95 mm long. Each of the first and second portions of the positioning guide are approximately 30 mm long, with each projecting arm being approximately 8 mm wide at the bottom, tapering to approximately 6 mm wide at the top. The spacer between each pair of arms is approximately 10 mm wide and the guide channels are approximately 2 mm wide. The first and second portions of the positioning guide are separated by a substantially cylindrical body having an external diameter of approximately 8 mm and a length of approximately 35 mm. The interior bore of the body is approximately 6 mm in diameter. Each annular flange of the positioning guide body has a width of about 1.5 mm and is located approximately 6 mm from a respective end of the positioning guide body, providing the body with a central region of around 20 mm in length. In one form, the positioning guide 200 is a condenser, as shown in FIG. 3. In another form, as shown in FIG. 4, the positioning guide 200 comprises a W roller that may or may not be configured to rotate along its longitudinal axis during use. The W roller comprises a substantially cylindrical body 200 having first and second portions 230*a*, 230*b* at each end of the body. The roller may also comprise a pair of bearings, one at each end of the body for engaging with a supporting structure to hold the roller in position. For example, the roller may comprise a bore extending along the length of the roller to allow the roller to be mounted on a revolving shaft to cause the roller to rotate. Optionally, the revolving shaft comprises the drafting arm that causes one or more drafting rollers to rotate. Optionally, the roller is made of steel or alloy or any suitable hardwearing material. The roller body 200 comprises two guide channels 281. In one form, as shown in FIG. 4, the roller body 200 comprises a pair of first and second guide channels 230*a*, 230*b*. In one form, especially when the roller rotates during use, each channel 230 substantially extends around the circumference of the roller body 200. The guide channels 281 may be of any suitable shape for guiding a filament 110 toward the desired location on or next to the roving. In one form, each channel is substantially w-shaped, as shown in FIG. 4. In another form, each channel may be substantially uu-shaped. In some forms, one channel may be a different shape to the other channel. Each channel 281 is configured to receive a filament 110 therein. The roller may be configured so that the guide channels are spaced from each other at any desired distance. Typically, the guide channels 281 are spaced from each other at a distance of between 3 to 13 mm. In one form, the guide channels are positioned to be 5-8 mm apart. In one form, the first guide channel 230*a* is located approximately 0 to 13 mm, preferably 0-8 mm, from a centreline of the roller body 200. Alternatively, or additionally, the second guide channel 230*b* is located approximately 0-13 mm, preferably 0 to 8 mm, from the centreline of the roller body 200 in the opposite direction.

The channels may be of any suitable depth and width. In one form, the channels are 6 mm deep and 1 mm wide at the narrowest point, which is located at the base of the channel.

Similarly, the roller body 200 may be of any suitable dimensions. In one form, the roller body is approximately 30 mm long and 40 mm in diameter. In one form, the roller body is configured to provide a shoulder of approximately 4 mm wide at a first end, followed by a first w-shaped channel being approximately 3 mm wide at its widest point. The first w-shaped channel is followed by a separating shoulder of approximately 10 mm wide and a second w-shaped channel of approximately 3 mm wide at its widest point. A further shoulder of approximately 10 mm wide is provided before the end of the roller body 210. In another form, the roller body may comprise three or more guide channels for guiding three or more filaments toward a desired location with respect to the roving. For example, in one form, the roller body may comprise four guide channels and may be located between two yarn production systems operating in parallel. In this form, two filaments from two adjacent guide channels may be guided to a desired location with respect to the roving of the first yarn producing system and the two filaments from the other two adjacent guide channels may simultaneously be guided to a desired location with respect to the roving of the second yarn producing system.

By selecting guides having channels at particular locations on the guide and at particular spacings from each other, where two or more channels are used, it is possible to introduce the filaments to the roving at different locations across the width of the drafting belt or next to the roving. When the filaments and roving are then twisted together, the different locations of the filaments within the roving can create different fibre structures. Therefore, by selecting different guide settings, it is possible to modify the fibre structure and profile of the yarns produced by the yarn spinning system in order to produce yarns having predetermined properties. Returning to the yarn production system, as the at least one filament 110 passes through the yarn producing system, the roving is simultaneously passed between a pair of drafting belts 170 to substantially stretch and spread the roving 120. At the end of drafting, the at least one filament 110 is introduced to the roving 120. Preferably, the filament is introduced to the roving at a desired location, such as at or near a predetermined distance from either side of the roving, by using a positioning guide, as described above. The at least one filament 110 may be introduced to the roving 120 at the final end of the drafting belt 170 or after the drafting belt. The strands of roving and continuous filament(s) in combination are then passed between at least one pair of reciprocating rollers 190. Each roller 190 rotates about its longitudinal axis and moves back and forth along its longitudinal axis in a reciprocating motion. The reciprocating rollers 190 are configured so that as one roller moves along its longitudinal axis in a first direction, the other roller moves along its longitudinal axis in a second direction, opposite to the first direction. The rollers 190 are located adjacent each other and have contact surfaces in contact with each other so that the combined strands of roving 120 and continuous filament(s) 110 are sandwiched between the roving and are twisted in the s-direction and in the z-direction as the strands pass between the reciprocating rollers. After exiting the reciprocating rollers 190, the roving 120 and continuous filament(s) 110 self-twist together to form a yarn 300, as shown in FIGS. 1 and 2.

The invention therefore provides a filament feed system and method configured to apply a predetermined amount of tension to one or more filaments before the filaments are introduced to a roving at set between 0-15 cm distances to achieve a technical yarn for a predetermined application.

Advantages

The system and method of the invention allow for the production of a variety of yarns having different fibre structures and properties by varying the tension applied to one or more filaments before introducing the filament(s) to the staple fibres during yarn production. Additionally, or alternatively, the fibre structures and properties of the yarns produced by the invention may be predetermined by introducing two or more filaments to a roving at one or more desired locations across the width of the drafting belt or next to the roving. Yarns may therefore be produced to have properties that are beneficial to the purpose of the fabrics that will ultimately be made from the yarns. For example, yarns that have a high fabric abrasion resistance may be used to produce fabrics for the automotive industry. The invention has been found to produce yarns that are less prone to fabric pilling; yarns that have a higher fabric burst strength; and yarns that have increased tenacity and elongation compared to conventionally manufactured yarns, Example A. The invention has also been found to increase the efficiency of short staple ring spinning yarn manufacture. The foregoing description of the invention includes preferred forms thereof. Modifications may be made thereto without departing from the scope of the invention. Furthermore, where known equivalents exist to specific features, such equivalents are incorporated as if specifically referred in this specification.

The invention claimed is:

1. A system for producing a yarn comprising at least two continuous filaments and a plurality of staple fibres that form a roving, wherein the system comprises at least one filament feed system configured to apply a predetermined amount of tension or no tension to the at least two continuous filaments before the at least two continuous filaments are introduced to the roving or to cause the at least two continuous filaments to be introduced to the roving under slack;

wherein the filament feed system comprises: two driven rollers; two press rollers; and two drive systems, wherein each press roller is configured to press against a respective driven roller and press at least one filament therebetween, and wherein each drive system is operatively connected to one of the driven rollers to cause that driven roller to rotate at a desired predetermined speed, and each drive system comprises a programmable controller to control and vary the rotational speed of one of the driven rollers; and wherein the filament feed system also comprises a closed feedback loop in which the filament feed system comprises one or more sensors to measure the rotational speeds of the driven rollers, wherein the one or more sensors are configured to provide the measured rotational speed data to the drive systems, and wherein each drive system comprises a controller that compares the desired rotational speed with the measured rotational speed of the driven roller and causes the drive system to adjust the rotational speed of the driven roller to equal the desired rotational speed, if the measured rotational speed is different to the desired rotational speed of the driven roller.

2. The system according to claim 1, wherein the drive systems are configured to cause one driven roller to rotate at a speed different to the other driven roller.

3. The system according to claim 1, wherein the filament feed system is configured to apply a predetermined amount of tension to at least two filaments before the filaments are introduced to the staple fibres.

4. The system according to claim 1, wherein the filament feed system is configured to introduce the filament to the roving without placing any tension on the filament.

5. The system according to claim 1, wherein after exiting the filament feed system, the filaments are introduced to the roving via a choice of two guides, one guide comprising a rotating roller in which a pair of substantially W-shaped channels are formed, wherein each channel is configured to receive a filament therein, and wherein the channels are spaced from each other at a distance of between 3 to 13 mm.

6. The system according to claim 1, and further comprising at least one optical sensor configured to identify breakages in at least one filament before the at least one filament is introduced to the roving.

* * * * *